United States Patent [19]

Bowen

[11] Patent Number: 4,835,895

[45] Date of Patent: Jun. 6, 1989

[54] HAND OPERABLE TELESCOPIC SIGHT MOUNTING SYSTEM

[76] Inventor: Hamilton S. Bowen, P.O. Box 67, Louisville, Tenn. 37777

[21] Appl. No.: 240,988

[22] Filed: Jan. 5, 1988

Related U.S. Application Data

[63] Continuation-in-part of Ser. No. 939,354, Dec. 8, 1986, abandoned.

[51] Int. Cl.[4] ..... F41G 1/38

[52] U.S. Cl. ..... 42/101; 33/250

[58] Field of Search ..... 42/101, 103; 33/249, 33/250

[56] References Cited

U.S. PATENT DOCUMENTS

| | | | |
|---|---|---|---|
| 3,424,420 | 1/1969 | Seiderman | 42/101 |
| 3,611,606 | 10/1971 | Sefried et al. | 42/101 |
| 4,310,980 | 1/1982 | Pilkington | 42/101 |
| 4,328,624 | 5/1982 | Ross | 42/101 |
| 4,341,022 | 7/1982 | Santoro | 42/101 |
| 4,353,180 | 10/1982 | Wilson | 42/101 |
| 4,383,371 | 5/1983 | Coffey | 42/101 |
| 4,418,487 | 12/1983 | Strahan | 42/101 |
| 4,531,321 | 7/1985 | Bechtel | 42/101 |
| 4,567,683 | 2/1986 | Buehler | 42/101 |
| 4,688,345 | 8/1987 | Kilgour | 42/101 |

OTHER PUBLICATIONS

*Guns & Ammo,* "The All-New ®Ruger's Super Redhawk is Flying High", Nov. 1987.

*Gun Digest,* 16th edition, 1962, p. 338.

*Gun Digest,* 7th edition, 1953, p. 203.

*Primary Examiner*—Deborah L. Kyle

*Assistant Examiner*—Michael J. Carone

*Attorney, Agent, or Firm*—Pitts and Brittian

[57] ABSTRACT

A hand operable scope ring system (10) for mounting a scope (12) on the barrel (14) of a firearm such as a rifle or pistol having a rib (916) with portions having a dovetailed cross-sectional outline and spaced-apart cuts opening on the upper surface of the rib (16). The scope ring system (10) includes a front ring member (24) and a rear ring member (24'). Each ring member has a ring (26) which releasably engages a scope (12). A mount (32) is provided which is mounted on the rib (16) of the barrel (14). The mount (32) has an alignment stud (50) which is received by a registering cut (22) in the rib. This mount defines a cross-sectional portion which receives the dovetailed portion of the barrel rib (16) and includes a threadably advanced securement member (40) which is moved into engagement with the barrel rib (16) for securing the mount in a zeroed position thereon. This position can be determined by the attitude of the lever arms (42) which are operatively associated with each securement member.

10 Claims, 2 Drawing Sheets

HAND OPERABLE TELESCOPIC SIGHT MOUNTING SYSTEM

This is a continuation-in-part application based upon parent application Ser. No. 939,354 filed Dec. 8, 1986 entitled "Hand Operable Scope Ring System".

DESCRIPTION

1. Technical Field

This invention relates generally to scope ring systems, and more particularly concerns a scope mounting system for a RUGER (trademark) type rifle, handgun or the like, having a barrel rib with a base portion having a dovetailed cross-sectional outline and spaced slots opening on the upper surface of the rib.

2. Background Art

Handgun and rifle scope ring systems have heretofore been known by those skilled in the art. Typically, such systems include a member, or members, which engage a scope and a member which secures the mount to the barrel. Known prior devices are illustrated in the following U.S. Pat. Nos.: 3,424,420; 4,328,624; 4,341,022; 4,353,180; 4,383,371; 4,418,487; 4,531,321; 4,567,683; 4,688,345 and 4,703,576.

Two other scope mounting systems are illustrated in U.S. Pat. No. 3,611,606 issued to H. H. Sefried, et al. on Oct. 12, 1971, and U.S. Pat. No. 4,310,980 issued to P. Pilkington on Jan. 19, 1982. The device of the '606 patent is designed specifically for a RUGER rifle. There is a forward ring member and a rearward ring member for embracing the barrel of a telescope sight unit. These ring members have beveled locking members that engage reverse-beveled surfaces of an upper rib on the rifle barrel. Each of these locking members are tightened against the rib using cross bolt members that pass through the members, one end (the "nut" end) of which is slotted to receive a screwdriver or similar tool. When the telescopic sight is to be mounted upon the rifle, the mating bevel surfaces are brought into contact, and the bolt members then tightened with the tool. When normal (open) sights of the rifle are to be used, the telescopic sight unit must be removed, again the tool is used to loosen the bolt members to disengage the beveled mating surfaces.

The device of the '980 patent is useful for other types of rifles and has a base element that is permanently attached to the top of the rifle barrel. A forward ring member for the scope mounts to the base with an oblong key that is received in an opening of the base, and is locked by rotation of the ring member. The rearward ring member is secured by two threaded members, one on each side of the ring, these threaded members have head portions with a rotary dovetail surface to engage notches in the base of the ring member. One of the head portions is slotted to receive a screwdriver or like tool, and the other head portion has a lever for movement during tightening or loosening.

A significant problem with scope-type sights is that they obscure the open sights provided on the rifle (or revolver) that are necessary for quick sighting of game during hunting. Typically, there are times for a hunter that the open sights are preferred, and other times when the scope sight is preferred. However, the scope mounting units of the prior art (with the exception of the sight mount of the '606 patent) are not amenable for quickly removing the scope sight and then reinstalling the same when needed in the field. Typically, the scope sight is useful for long shots in the open, but the open sights are an advantage in the brush for close range work on moving game. In target shooting in contrast, either the open sights or the telescopic sight is used and there is no need to quickly install or remove the scope sight. Also, with target shooting the scope sight, once zeroed, is properly set on the weapon.

While the scope sight mounting of the '606' patent provides for rather quickly installing or removing the scope sight on a RUGER weapon, it has two basic faults: a tool is required to tighten the bolt members; and a variation of the sighting through the scope occurs because small differences can exist in the position of the ring member each time they are mounted on the gun. These differences although of the order of parts of thousands of an inch, can have a significant effect upon the impact points of the projectile at the "target" located at one hundred yards, for example. An article written in the November 1987 issue of "Guns & Ammo" about the system of the '606 patent indicated that the impact points can shift at least one and one-half inches at 100 yards upon reinstalling a scope sight. This was with a 0.44 RUGER magnum. Further, it can be shown mathematically that if the alignment of the scope rings is shifted as little as 0.0005 inches the impact shift at 100 yards will be 0.72 inches.

The differences in position from one mounting of the scope sight of the '606 patent to another mounting can be due to several factors. For example, it may be difficult to always achieve the exact equal tightening of the cross bolts each time. In addition the bevel or cam surfaces of the scope mount and/or the rib on the barrel can become burred, deformed or otherwise changed to prevent exact setting of the ring mount unit. Similarly, tightening of the cross bolts can occur when the respective surfaces of the rib and the ring mounts are not fully mated, with the result that one or both of the ring mounts is positioned differently than when the scope sight was zeroed.

A further and more serious problem of proper zeroing of the scope sight each time such sight is mounted on the weapon arises due to the imprecision of the scope mount components which are often cast metal. Thus, unless some uniform tightening of the base mounts upon the rib is achieved, varying torsional and other stresses are imposed upon the tube of the sight that result in distortion and varying amounts of misalignment.

Accordingly, it is an object of the present invention to provide a hand operable scope ring system for mounting a scope sight on the barrel of a firearm, such as a rifle or handgun, having a rib with base portions defining a dovetailed cross-sectional outline and spaced cuts opening on the upper surface of the rib.

It is another object to provide such a scope mounting system that can be readily installed or removed without the need for special tools such that access can be gained to the mechanical sights of the rifle or handgun at any time.

It is also an object of the present invention to provide such a scope mounting system having a mechanism for truing the system to readily indicate to a user that the ring system carrying the scope has been placed in a zeroed position.

These and other objects and advantages of the present invention will become apparent upon a consideration of the drawings referred to hereinafter, and the detailed description thereof.

DISCLOSURE OF THE INVENTION

In accordance with the present invention there is provided a hand operable scope ring system for mounting a scope sight on the barrel of a firearm, such as a rifle or pistol, having a rib with a portion defining a dovetailed cross-sectional outline. The rib has a base which defines spaced cuts opening on its upper surface. A front and rear ring member serves to support the opposite end portions of a scope. Each of these ring members includes a ring portion which engages the scope and a mount portion which can be mounted on the rib of the barrel. The mount portion has an alignment stud which is received by a registering cut in the barrel rib. This mount portion defines a channel which receives the dovetailed cross-sectionally outlined portion of the base portion of the barrel rib, and includes a threadably advanced securement member which is moved into engagement with the barrel rib at the base for securing the ring in a zeroed position. Lever arms are operatively associated with one end of each of the securement members for threadably advancing the securement members until the zeroed position is attained. The attitude of the lever arms indicates to a user the point at which such zeroed position is reached. In the preferred embodiment, the opposite end of each of the securement members is provided with parallel ridges to assist in alignment of mating surfaces of the mount portions of the ring members and the rib.

BEST MODE FOR CARRYING OUT THE INVENTION

Figure 2:
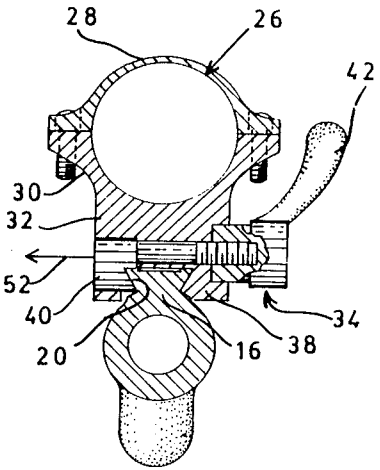
FIG. 2 illustrates a cross-sectional view taken along the line 2—2 in FIG. 1.
Figure 1:
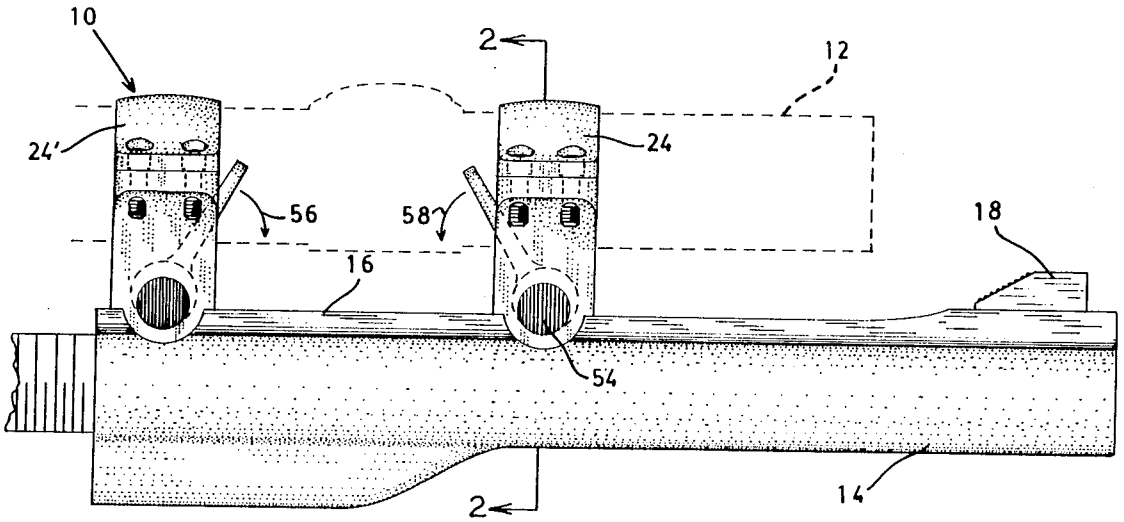
FIG. 1 is an elevation view of a scope sight mounted on a barrel, such as the barrel of a handgun or rifle defining a rib with base portions having a cross-sectionally outlined portion and spaced cuts opening on the upper surface of the rib. This barrel carries a hand operable scope ring system constructed in accordance with various features of the present invention and illustrates the lever arms, used in securing the front and rear ring members, in a similar attitude indicating that the zeroed position of the scope sight has been reached. Also illustrated is the ridged end of cross bolts of the mount as used to align mating portions of the scope mounting rings and the surfaces on the rib.
Figure 4:
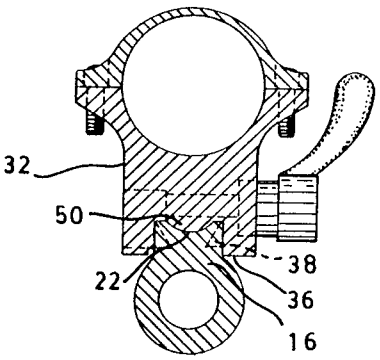
FIG. 4 illustrates a sectional view of the system illustrated in FIG. 1 and taken in a plane to more clearly define the alignment stud received within the spaced cuts of the base opening on the upper surface of the barrel rib.

A hand operable scope ring system is generally indicated at 10 in FIG. 1. This scope ring system is designed for mounting a scope sight 12, which is of conventional design, on a barrel 14 of a firearm such as a rifle or handgun having a rib with a dovetailed cross-sectionally outlined base portion, as is illustrated more generally at 16, along the length of the barrel and carries the mechanical sight 18 as illustrated in FIG. 1. This rib includes cross-cut slots at the location upon which the mounts are positioned as is depicted in FIG. 2. These cross-cut slots define the base portion of the rib having a dovetailed cross-sectional outline upon which the mounts are positioned. It will also be noted that proximate the location of the cross-cut slots 20 on opposite sides of the rib as illustrated in FIGS. 2 and 4, spaced cuts 22 open on the upper surface of the rib. These cross-cuts or slots defining a dovetailed portion of the rib and the cuts 22 are of conventional design in the base of the RUGER (trademark) type system. Thus, the scope ring system 10 of the present invention is particularly suited for use in connection with such a RUGER (trademark) system.

The scope ring system 10 includes a front or forward ring member 24 and a rear ring member 24' as illustrated in FIG. 1. These ring members are substantially identical in construction with the exception that the threaded members are preferably of the opposite hand which will be described in greater detail hereinafter. Other than this exception, a description of one ring member will suffice as a description of the other. Accordingly, the forward ring member 24 will be described in detail.

The ring member 24 has a ring 26 which releasably engages the barrel or substantially cylindrical outer surface of the scope 12 as illustrated in FIG. 1. This ring 26 includes an upper member 28 which mates with a lower member 30 to define the circular recess illustrated in FIGS. 2 and 4 which receives the scope. It will be noted that these two members 28 and 30 are joined at their perimeter by the illustrated threaded members of conventional design shown in FIGS. 1 and 2. The lower member 30 of the ring 26 is mounted on a mount 32 depicted in FIGS. 2 and 4. This mount is releasably mounted on the rib 16 proximate the location of the cross-cuts which define the base portion of the rib having a dovetailed cross-sectional outline. In this connection, the mount carries means for securing the ring member 24 to the barrel rib. The illustrated securing means generally indicated at 34 in FIGS. 2 and 4 is mounted on the mount 32 proximate the channel 36 opening on the lower surface of the mount 32. This channel 36, as can be seen in FIG. 4, is designed for receiving the base portion of the rib 16 of the barrel. The channel is substantially rectangular in cross-sectional outline and includes within its length, a portion of the means for securing the ring member to the rib at the location of the dovetailed portion thereof.

The securement means 34 includes a first dovetailed member 38 which is received within a cross-cut slot 20 as shown in FIGS. 2 and 4. This dovetailed member 38 mates with a further securement member 40 which is designed for engaging the opposite cross-cut slot as shown in FIG. 2. The securement member 40 includes a portion, as illustrated in FIGS. 2 and 4, which is designed for being received within the cross-cut slot 20. As this securement member 40 is threadably advanced towards the securement member 38 a force fit between the ring member 24 and the base portion of the barrel rib is produced. To this end, the securement member 40 is threadably advanced toward the securement member 38 by turning the lever arm 42 in a selected direction as illustrated by the arrows 56, 58 in FIG. 1. It will be noted that this lever arm includes an internally threaded portion shown in FIG. 2 which threadably receives the externally threaded portion of the stud 44 which is joined at its opposite end with the securement member 40. It will also be noted in FIG. 2 that a shouldered bore is provided in the mount 32 for receiving the stud 44, the securement member 40 and the internally threaded portion of the lever arm 42. Upon turning the lever arm 42 the securement member 40 is advanced after it is placed in registration with the cooperating cross-cut defined in the base portion of the rib until the ring member 24 reaches the zeroed position.

One important feature of the present invention is the provision of means for determining the location of the zeroed position. To this end, the lever arms 42 and 42' are threadably connected with the externally threaded portion of the studs 44 and 44', respectively, such that the securement members 40 and 40' are advanced by turning the lever arms in opposite directions. The length of the studs, and the dimensions of the components of the means for securing 34 are selected such that when the lever arms reach a similar attitude the ring system has been moved to its zeroed position. It will be noted in FIG. 1, that the lever arms are in a similar attitude, that is they are positioned such that their respective angle away from vertical is substantially equal and they have a symmetrical appearance. It is this attitude that indicates to the user that a zeroed position has been attained.

Figure 3:
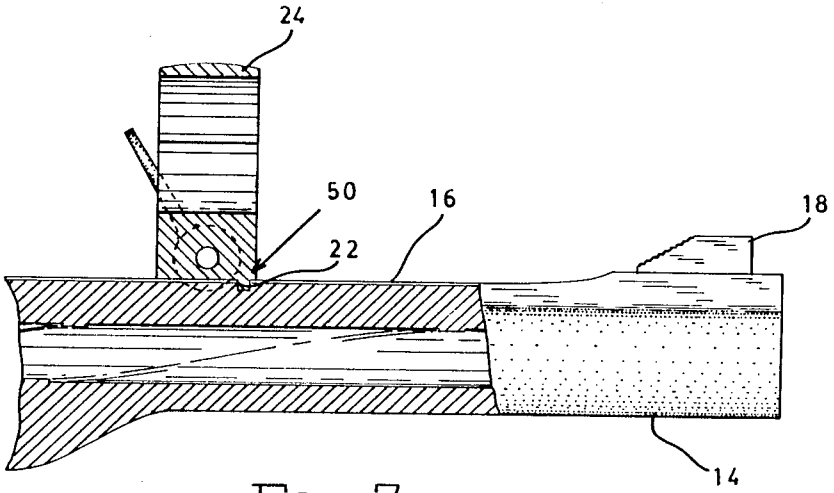
FIG. 3 illustrates a partial sectional side elevation view of the forward ring member illustrated in FIG. 1.

In order to facilitate attainment of a zeroed position, an alignment stud 50 is carried by the mount 32 and extends within to the area of the channel 36 as shown in FIG. 4. This alignment stud 50 has a curved distal end portion which is received within the cut 22 as illustrated in FIG. 3.

During the installation of a ring system, the securement members 40 and 40' are moved outwardly in the direction of the arrow 52 to clear the channel 36. Each ring member is then positioned on the rib such that the alignment studs 50 are received within the juxtaposed registering cut 22. The securement members 40 and 40' are then advanced in a direction opposite the arrow 52 by turning the lever arm in the appropriate direction until it moves in to the registering cross-cut 20, the dovetailed members 38 having been placed in registration with the opposite cross-cut upon alignment of the stud 50 with the cut 22.

Registration of the members 40 and 38 with the registering cross-cuts 20 is facilitated by the provision of a knurled surface 54 of parallel ridges on the base of the securement member 40. This knurled surface 54 (see FIG. 1) serves to frictionally engage the tip of a finger of an operator to facilitate rocking the ring member into position such that the cross-cuts are placed in proper registry with the dovetailed portions of the securement means prior to rotation of the lever arms in the direction of the arrows 56 and 58 illustrated in FIG. 1 to produce the zeroed position. As can be seen in FIG. 1, the parallel ridges of the knurled surface 54 associated with the securement members 40, 40' have a pattern that is identical. Thus, visual observation of these knurled surfaces can detect proper alignment of mating surfaces prior to operation of the lever arms 42, 42'.

From the foregoing detailed description, it will be recognized that a specialized hand operable scope ring system has been provided for mounting a scope sight on a barrel of a firearm having a rib designed for a RUGER (trademark) system or the like. The ring system requires no alternation of the firearm and can readily be installed by an end user without modifications. The system can also be removed without the use of special tools. This feature has particular practicality in the event a user desires to gain access to the mechanical or open gun sights in the field. The user, again without special tools, can readily discern the zeroed position of a remounted scope sight by inspecting the attitude of the lever arms which serve to drive threaded members of opposite hand. A zeroed position attitude is illustrated in FIG. 1 which further illustrates that the lever arms are (preferably) turned in opposite directions until the securement members 40 and 40' reach the desired zeroed position. The knurled surfaces are also provided to assist in rocking the individual mounts into place such that the securement means components are aligned with the cross-cuts defined in the base of the barrel rib prior to tightening using the lever arms.

Thus, although there has been described to this point a particular embodiment of the present invention of a scope ring system for mounting a scope sight on a particular type gun, it is not intended that such specific references be considered as limitations upon the scope of this invention except insofar as set forth in the following claims.

I claim:

1. A hand operable scope ring system for repetitively mounting a scope sight in a zeroed position on the barrel of a firearm having a rib with cross-cuts, each cross-cut having oppositely disposed surfaces, which define base portions having a dovetailed cross-sectional outline and spaced cuts opening on the upper surface of said rib, said scope ring system comprising:

a front ring member and a rear ring member, each ring member including (a) a ring portion which releasably engages a scope sight, (b) a mount portion which is releasably mounted on said rib of said barrel, said mount portion defining a channel to receive said rib, said mount portion having an alignment stud extending into said channel for being received by a registering cut opening on said upper surface of said rib, one side of said channel defining a dovetailed surface for engagement with one of said oppositely disposed surfaces of said cross-cuts, (c) securement means for releasably securing said mount portion to said barrel, said securement means including a first securement member defining a surface for engagement with a second of said oppositely disposed surfaces of said cross-cuts, said first securement member having an externally threaded bolt portion passing through said mount portion, and a second securement member threadably engaged with said bolt portion for movement into engagement with said mount portion for securing said ring member in a zeroed position on said rib, said first securement member having an exposed surface provided with a knurled portion of parallel ridges, said knurled portion providing for engagement by a finger of a user to facilitate rocking said ring member into position prior to said movement of said second securement member into engagement with said mount portion, and (d) a lever arm operatively associated with said second securement member at a selected orientation for use in threadably advancing said second securement member on said bolt portion;

said selected orientation of said lever arm of said front ring member and said lever arm of said rear ring member chosen whereby when said ring members are placed in said zeroed position on said rib said lever arms have a similar rotational attitude.

2. The hand operable scope ring system of claim 1 wherein said lever arm operatively associated with said front ring member and said lever arm operatively associated with said rear ring member are rotatable in opposite directions for advancing said operatively associated securement members into engagement with said cross-cuts for securing said ring members in said zeroed position.

3. A hand operable scope ring system for mounting a scope sight on the barrel of a firearm having a rib with cross-cuts which define base portions having a dovetailed cross-sectional outline and spaced cuts opening on the upper surface of the rib, said scope ring system including:

a front ring member and a rear ring member, each ring member including a ring which releasably engages a scope and a mount portion which is releasably mounted on said rib of said barrel, said mount defining a channel for receiving said rib, said channel having an alignment stud extending therein for being received by a registering cut opening on said upper surface of said barrel rib, and securement means for receiving said dovetailed cross-sectional outline portion of said barrel rib, said securement means including a threadably advanced securement member which is moved into engagement with said barrel rib for securing said ring member in a zeroed position on said barrel rib, said threadably advanced securement member having an operatively associated lever arm to facilitate advancement thereof, and wherein said lever arm operatively associated with said front ring member and said lever arm operatively associated with said rear ring member are rotatable in opposite directions for advancing said operatively associated securement members into engagement with said cross-cuts for securing said ring members in said zeroed position, said lever arms being oriented at a selected angle on said securement members whereby when said ring members are placed in said zeroed position each of said lever arms are in a similar but oppositely directed attitude and means for facilitate rocking each ring member into position on said rib prior to rotation of said lever arms.

4. The hand operable scope ring system of claim 3 wherein said means for facilitating the rocking of said ring member into position comprises a knurled portion of parallel ridges proximate one end portion of said securement means opposite said securement member with said operatively associated lever arm whereby said knurled portion can be frictionally engaged by the tip of a finger of an operator to facilitate said rocking motion.

5. The hand operable scope ring system of claim 3 wherein said securement means defines a dovetailed member which engages a cross-cut on one side of said rib, said dovetailed member being integrally formed with said mount of said ring member and cooperating with said threadably advanced securement member for fixing the position of said ring member on said barrel rib.

6. The hand operable scope ring system of claim 5 wherein said dovetailed member and said threadably advanced securement member extend into said channel defined by said mount when said ring member is moved into said zeroed position.

7. The hand operable scope ring system of claim 4 wherein said knurled portion has ridges of a selected orientation whereby said orientation provides visual indication when said ring member is rocked into position on said rib.

8. In a mounting system for a telescopic sight having a first and second mount means, each mount means having a scope receiving ring and a sight mount for mounting said scope on a barrel of a firearm, the firearm provided with a rib along an upper surface thereof, the rib having an essentially flat upper surface and two recesses disposed on opposite sides of the rib at at least two locations along the rib, each recess having an inwardly inclined bearing surface, said rib provided with cut-out portions adjacent said recesses, said mount means having a base defining a channel to receive said rib and a stud extending into said channel to engage said cut-out portions, a side surface of said channel adapted to contact a first of said bearing surfaces, said mount means further provided with a locking member, said locking member having a first securement member on one side of said mount base having an inclined surface to contact a second of said bearing surfaces and a threaded bolt member passing through said mount base, and a second securement member on an opposite side of said mount base threadably engaged with said bolt member whereby rotation of said second securement member relative to said bolt member threadably advances said inclined side surface of said mount base and said inclined surface of said first securement member into engagement with said inclined surfaces of the rib, the improvement comprising:

providing on an exposed surface of each of said first securement members a knurled portion of parallel ridges, said knurled portion providing for contact by a finger of a user to facilitate rocking said first and second mount means on said rib whereby said stud is positioned in said cut-outs and said inclined surfaces of said mount bases and said first securement members are against said inclined bearing surfaces of said opposed recesses in said rib; and a lever arm attached to each said second securement members of said first and second mount means at a selected angle thereto whereby when said securement means have been threadably advanced sufficiently to place said mounting system in a zeroed position for said scope, said lever arms have a substantially similar rotational attitude with respect to said barrel.

9. The mounting systems of claim 8 wherein said bolt member of said first mount means is threaded oppositely from said bolt member of said second mount means whereby said lever arms are rotatable in opposite directions to threadably advance said inclined surface of said mount base toward said inclined bearing surfaces of said rib, whereby when said scope in said mounting system is in said zeroed position on said barrel said lever arms have oppositely directed but substantially equal rotational attitude with respect to said barrel.

10. The mounting system of claim 8 wherein said parallel ridges of said knurled surfaces on said first securement members have a selected orientation, said orientation providing visual indication that said first and second mount means are rocked into position on said rib.

* * * * *